US007523630B2

(12) United States Patent
Skjellerup

(10) Patent No.: US 7,523,630 B2
(45) **Date of Patent: *Apr. 28, 2009**

(54) SECURITY TAG ASSEMBLY

(76) Inventor: Johan Skjellerup, P.O. Box 811269, Boca Raton, FL (US) 33481

( * ) Notice: Subject to any disclaimer, the term of this patent is extended or adjusted under 35 U.S.C. 154(b) by 97 days.

This patent is subject to a terminal disclaimer.

(21) Appl. No.: 11/182,733

(22) Filed: Jul. 15, 2005

(65) Prior Publication Data

US 2006/0017574 A1 Jan. 26, 2006

Related U.S. Application Data

(63) Continuation of application No. 10/828,366, filed on Apr. 20, 2004, now abandoned, which is a continuation-in-part of application No. 10/207,354, filed on Jul. 29, 2002, now Pat. No. 6,722,166.

(51) Int. Cl.
*E05B 65/00* (2006.01)

(52) U.S. Cl. ..... 70/57.1; 340/572.1; 24/704.1

(58) Field of Classification Search ..... 70/57.1, 70/182–186, 233; 24/704.1; 340/572.7, 340/572.8; 292/DIG. 59, DIG. 66
See application file for complete search history.

(56) References Cited

U.S. PATENT DOCUMENTS

| | | | |
|---|---|---|---|
| 3,974,581 | A | 8/1976 | Martens |
| 4,299,870 | A | 11/1981 | Humble |
| 4,339,853 | A | 7/1982 | Lipschitz |
| 4,523,356 | A | 6/1985 | Charlot, Jr. |
| 4,527,310 | A | 7/1985 | Vandebult |
| 4,590,461 | A | 5/1986 | Cooper |
| 4,603,453 | A | 8/1986 | Yokoyama |
| 4,651,136 | A | 3/1987 | Anderson et al. |
| 4,670,950 | A | 6/1987 | Wisecup et al. |
| 4,685,234 | A | 8/1987 | Anderson et al. |
| 4,774,503 | A | 9/1988 | Bussard |
| 4,884,833 | A | 12/1989 | Pedersen |
| 4,944,075 | A | 7/1990 | Hogan |
| 4,993,245 | A | 2/1991 | Ott |
| 5,031,287 | A | 7/1991 | Charlot, Jr. et al. |
| 5,054,172 | A | 10/1991 | Hogan et al. |
| 5,077,872 | A | 1/1992 | Guthammar |
| 5,088,165 | A | 2/1992 | Minasy et al. |
| 5,151,684 | A | 9/1992 | Johnsen |
| 5,205,024 | A | 4/1993 | Willard |
| 5,208,580 | A | 5/1993 | Crossfield |
| 5,347,262 | A | 9/1994 | Thurmond et al. |

(Continued)

FOREIGN PATENT DOCUMENTS

| | | |
|---|---|---|
| EP | 0 404 329 A1 | 12/1990 |

(Continued)

*Primary Examiner*—Suzanne D Barrett
(74) *Attorney, Agent, or Firm*—Malloy & Malloy, P.A.

(57) ABSTRACT

A security tag assembly structured to indicate the unauthorized removal of merchandise from a given area such as a retail establishment. A housing includes separable portions having a connector member structured to removably connect the merchandise to the housing and positionable into removable and locking engagement with a locking assembly when the housing is in an operative position relative to the merchandise. A shield assembly is mounted on the housing in protective, preferably surrounding or at least partially enclosing relation to the locking assembly so as to restrict unauthorized access to the locking assembly and/or the positioning thereof relative to the connector member.

12 Claims, 3 Drawing Sheets

U.S. PATENT DOCUMENTS

| | | | |
|---|---|---|---|
| 5,367,289 | A | 11/1994 | Baro et al. |
| 5,426,419 | A | 6/1995 | Nguyen et al. |
| 5,497,639 | A | 3/1996 | Charlot, Jr. |
| 5,587,703 | A | 12/1996 | Dumont |
| 5,600,977 | A | 2/1997 | Piron |
| 5,613,384 | A | 3/1997 | Weber et al. |
| 5,748,089 | A | 5/1998 | Sizemore |
| 5,786,762 | A | 7/1998 | Liu |
| 5,912,622 | A | 6/1999 | Endo et al. |
| 5,955,951 | A | 9/1999 | Wischerop et al. |
| 6,023,951 | A | 2/2000 | Maurer et al. |
| 6,281,800 | B1 | 8/2001 | Sizemore |
| 6,348,865 | B1 | 2/2002 | Siegel |
| 6,535,130 | B2 | 3/2003 | Nguyen et al. |
| 6,722,166 | B2 | 4/2004 | Skjellerup |
| 6,724,307 | B1 | 4/2004 | Siegel |
| 6,752,837 | B2 | 6/2004 | Karp |
| D494,488 | S | 8/2004 | Sayegh |
| 6,774,794 | B2 | 8/2004 | Zimmerman et al. |
| 7,073,236 | B2 | 7/2006 | Xue et al. |
| 7,075,440 | B2 | 7/2006 | Fabian et al. |
| 7,148,805 | B2 | 12/2006 | Hogan |
| 7,286,054 | B2 | 10/2007 | Skjellerup et al. |
| 7,382,256 | B2 * | 6/2008 | Skjellerup et al. ..... 340/572.1 |
| 2002/0105424 | A1 | 8/2002 | Alicot et al. |
| 2003/0067397 | A1 | 4/2003 | Trimble |
| 2004/0016269 | A1 | 1/2004 | Skjellerup |
| 2004/0231375 | A1 | 11/2004 | Skjellerup |
| 2004/0233042 | A1 | 11/2004 | Piccoli et al. |
| 2005/0218218 | A1 | 10/2005 | Koster |
| 2006/0017574 | A1 | 1/2006 | Skjellerup |
| 2006/0125643 | A1 | 6/2006 | Skjellerup et al. |
| 2006/0139176 | A1 | 6/2006 | Skjellerup et al. |
| 2006/0208908 | A1 | 9/2006 | Skjellerup et al. |
| 2007/0273523 | A1 | 11/2007 | Skjellerup et al. |

FOREIGN PATENT DOCUMENTS

| | | |
|---|---|---|
| EP | 0 594 324 A2 | 4/1994 |
| EP | 1 391 574 B1 | 2/2004 |
| JP | 2005-71143 | 3/2005 |

* cited by examiner

FIG. 1
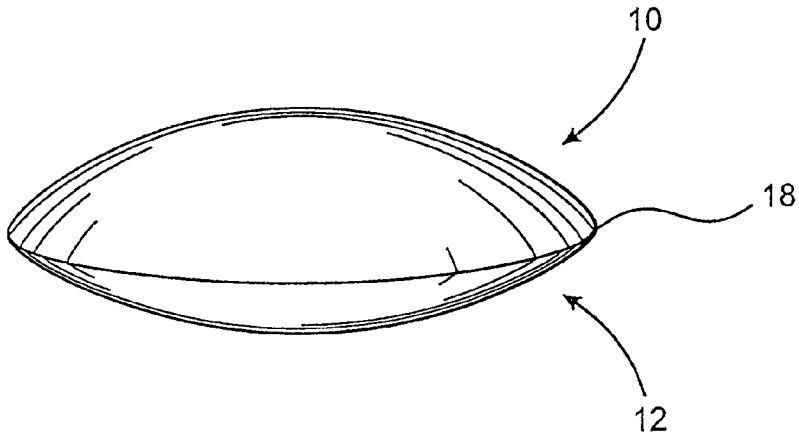
FIG. 2
FIG. 3
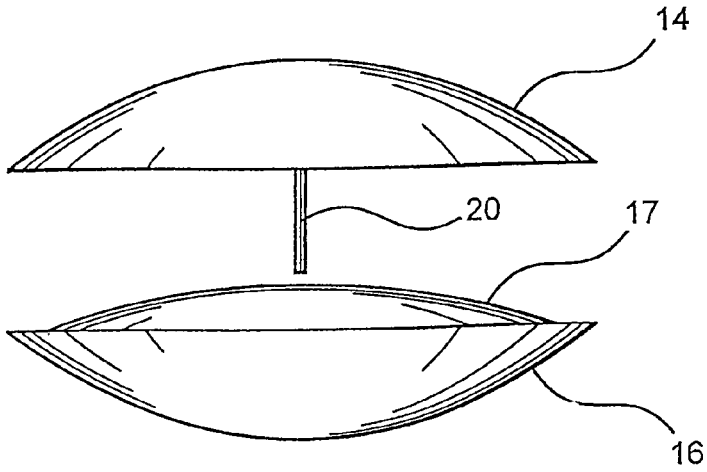
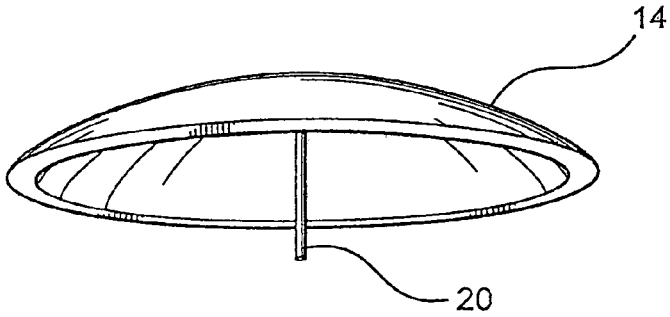
FIG. 4
FIG. 5
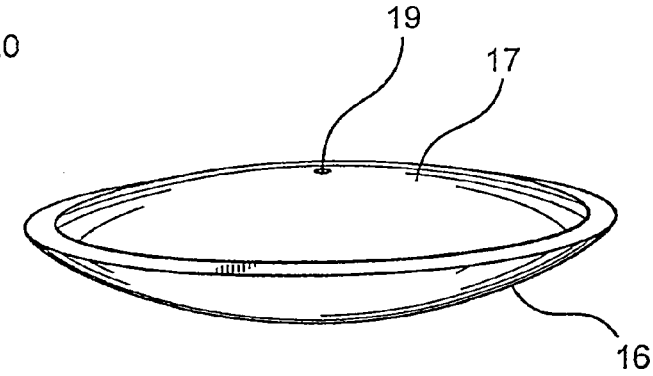

SECURITY TAG ASSEMBLY

CLAIM OF PRIORITY

The present application is a continuation application of previously filed, application having Ser. No. 10/828,366, filed on Apr. 20, 2004 now abandoned incorporated herein by reference, which is a continuation-in-part application to U.S. application Ser. No. 10/207,354, filed Jul. 29, 2002, now U.S. Pat. No. 6,722,166 issued on Apr. 20, 2004 also incorporated herein by reference.

BACKGROUND OF THE INVENTION

1. Field of the Invention

This invention relates to an anti-theft security tag assembly which can be operatively attached to various types of merchandise and which includes an indicator assembly providing one or more indications of unauthorized removal of the merchandise from a retail establishment or other area. Shielding is provided to prevent unauthorized removal of the tag assembly from the merchandise.

2. Description of the Related Art

Security or anti-theft tags are extensively used in the retail merchandising industry as well as numerous other areas of commerce. In typical fashion, such devices are attached to various types of merchandise in such a manner that that they are clearly obvious by one examining the merchandise. Common knowledge of the use and operation of such devices is believed to prevent or at least restrict the theft or other unauthorized removal of merchandise from the retail outlet or other area being monitored. More specifically, it is believed that such security tag devices serve as a deterrent to unauthorized removal in that a potential thief will recognize that the merchandise will be "stained" or otherwise marked, thereby rendering the merchandise useless, upon forced removal of the security tag. Alternatively the tag may be structured to activate an alarm system as the merchandise, incorporating the tag thereon, passes through a monitoring station typically located at the exits to the retail establishment.

Due to the popularity of security or anti-theft devices of the type described above, numerous attempts have been made to design and structure a device which not only serves as a deterrent against theft, but which includes structural features intended to overcome any attempt to defeat the device which may be applied by an experienced thief. In addition, the structure of such security devices should be such as to be easily secured to and removed from different types of articles such that a device of substantially standard structure can be used to monitor and protect various types of merchandise.

As set forth above known security or anti-theft tags are intended to provide some indication which either renders the merchandise useless or alternatively signals an attempted unauthorized removal. As such, at least one type of indicator is structured to release an ink or colored staining agent upon a forced removal of the security device from the merchandise, such as by rupturing the outer casing or other portions thereof. The released staining agent is difficult, if not impossible, to remove from the protected merchandise thereby clearly indicating that the stained article has been stolen. In addition, such anti-theft devices may include some type of electronic signaling mechanism. This type of device activates an alarm by passing through or in predetermined proximity to a monitoring station, as set forth above. However, because of the large number of practical applications for such security devices, the various users thereof may request one or the other of the aforementioned types of indicators (ink stain or electronic signaling). Also, a retailer may in fact desire more than one type of indicator or different types of "customized" indicator or signaling devices which better protect against the unauthorized removal of merchandise from a given area.

While popular, it is recognized that a significant number of the anti-theft tags currently being utilized include problems or disadvantages which render them less than totally efficient. More specifically, wide spread knowledge of the structural features of such security tags allows unauthorized personnel to develop techniques which are specifically designed to remove the tag from the merchandise in a manner which defeats the aforementioned indicator structures. Therefore it is not uncommon for a skilled or experienced thief to develop tools or techniques to remove the merchandise from the area being monitored without damage to the stolen article or activation of an alarm or monitoring system.

Accordingly there is a recognized need in the security industry for an anti-theft device preferably in the form of a relatively small security tag assembly which efficiently locks onto various types of merchandise and which is specifically structured to overcome known techniques used to remove or otherwise defeat such devices. By way example, one method commonly employed by a potential thief is to apply heat or a small flame, of the type generated by a cigarette lighter, to predetermined portions of the tag housing. In doing so the housing may be accessed for purposes of removing operative components thereof which serve to maintain the device in locking engagement on the merchandise, without releasing the staining agent or otherwise activating monitoring alarms.

Therefore, an improved or preferred security tag assembly should include specific structural features which overcome attempts to defeat the device, such as, but not limited to, the method set forth above. Moreover, such protective structural features should be compatible with standardized tag construction and configurations. This would enable the tag manufacture or provider to effectively "customize" the indicator assembly to include staining agents, electronic signaling devices or both, while not requiring a restructuring or redesign of the entire tag or the remaining, basic operable components associated therewith.

SUMMARY OF THE INVENTION

The present invention is directed to a security tag assembly, also commonly known as an anti-theft tag, structured to be connected in an operative position to various types of merchandise. The aforementioned operative position of the device is more specifically described as a housing thereof being mounted, secured, etc. on or to the merchandise in a substantially obvious location so as to inform the potential buyer that the particular merchandise is being protected against unauthorized removal.

Accordingly, the security tag assembly of the present invention comprises a housing having at least two separable portions defining the exterior of the tag. A plurality of operable components are located within the housing between and in some cases connected to a specific one of the separable housing portions. Moreover, one of the separable portions includes a connector member fixedly secured thereto and structured to removably engage the merchandise being protected. In at least one preferred embodiment the connecting member may be in the form of an elongated pin structured to penetrate the merchandise with no discernable damage being done thereto.

Further, a locking assembly is mounted within the housing in receiving relation to the connector member. When the connector member is engaged by the locking assembly it is maintained in the aforementioned operative position, wherein the housing is "locked" onto the merchandise. The locking assembly is structured to be selectively positioned between its locking engagement with the connector member and a position which releases the locking member. In the latter position of the locking assembly, the separable portions of the housing may then be separated and the merchandise can be disconnected from the housing without damage, such as when the merchandise is properly purchased and the removal of the security tag assembly is authorized.

As will be described in greater detail hereinafter, the locking assembly may be of the type structured to be selectively unlocked from the connector member when it is exposed to an externally applied force, such as a magnetic force. The magnetic force is applied from an exterior of the housing by authorized personnel, using equipment provided by the retail establishment. It is of course contemplated that the locking assembly may assume a variety of other structures which are specifically operative to maintain the housing in an operative position, secured to the merchandise, or be selectively disconnected therefrom.

In the manufacture and use of security tag assemblies or anti-theft tags it is common knowledge that unauthorized personnel attempt to defeat the security tags and remove them from the merchandise being protected by a variety of known techniques. One such technique includes the application of heat and/or flame to a predetermined exterior portion of the housing in attempt to disable, reorient and/or remove the locking assembly from its locked engagement with the connector member. Therefore, a structural and operative feature of the present invention is the inclusion of a shield assembly mounted within the housing and disposed and structured to protect the locking assembly from being accessed through the application of heat or flame.

Accordingly, the shield assembly of the present invention comprises what may be considered a "cup-like"structure having a hollow interior and an access opening formed generally at one end thereof. Both the access opening and the hollow interior are dimensioned and configured to receive at least a majority of the locking assembly therein. As such, the shield assembly substantially surrounds or at least partially encloses a significant portion of the locking assembly. Further, the shield assembly is formed from a metallic or other heat resistant material in order to resist the external application of heat, flame, etc. to the housing in order to accomplish unauthorized access to the locking assembly and/or manipulation thereof.

Another structural feature of the present invention is the generally standardized structuring of the housing, as well as the remaining operable components thereof, in order to accommodate one or more preselected indicator members. Further, the manufacturer or provider of the subject tag assembly may easily replace and/or "customize" the indicator assembly by providing a plurality of different indicator members or one or more of the same type of indicator members, without varying the structural configuration of the remainder of the device. As is well recognized in the security tag industry, such indicator members may be in the form of ink or staining agent capsules or reservoirs which serve to stain the merchandise upon attempted removal or the housing from the merchandise. Alternatively, one or more of the indicator members may include some type of electronic signaling device specifically structured to activate one or more alarms located at monitoring stations, typically positioned at the exit of a retail establishment or other given area being monitored. It is emphasized that a variety of other indicator members may be utilized dependent upon the desires and needs of the consumer intending to implement such security tag assemblies.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 1 is a perspective view of the housing of the security tag assembly of the present invention.

FIG. 2 is a front plan view of one of the separable portions of the housing of the embodiment of FIG. 1 with a connector member secured thereto.

FIG. 3 is a front plan view of the other of two separable portions of the housing of the embodiment of FIG. 1 with an interior housing section secured thereto.

FIG. 4 is a perspective view of the embodiment of FIG. 2.

FIG. 5 is a top perspective view of the embodiment of FIG. 3.

Like reference numerals refer to like parts throughout the several views of the drawings.

DETAILED DESCRIPTION OF THE PREFERRED EMBODIMENT

Figure 6:
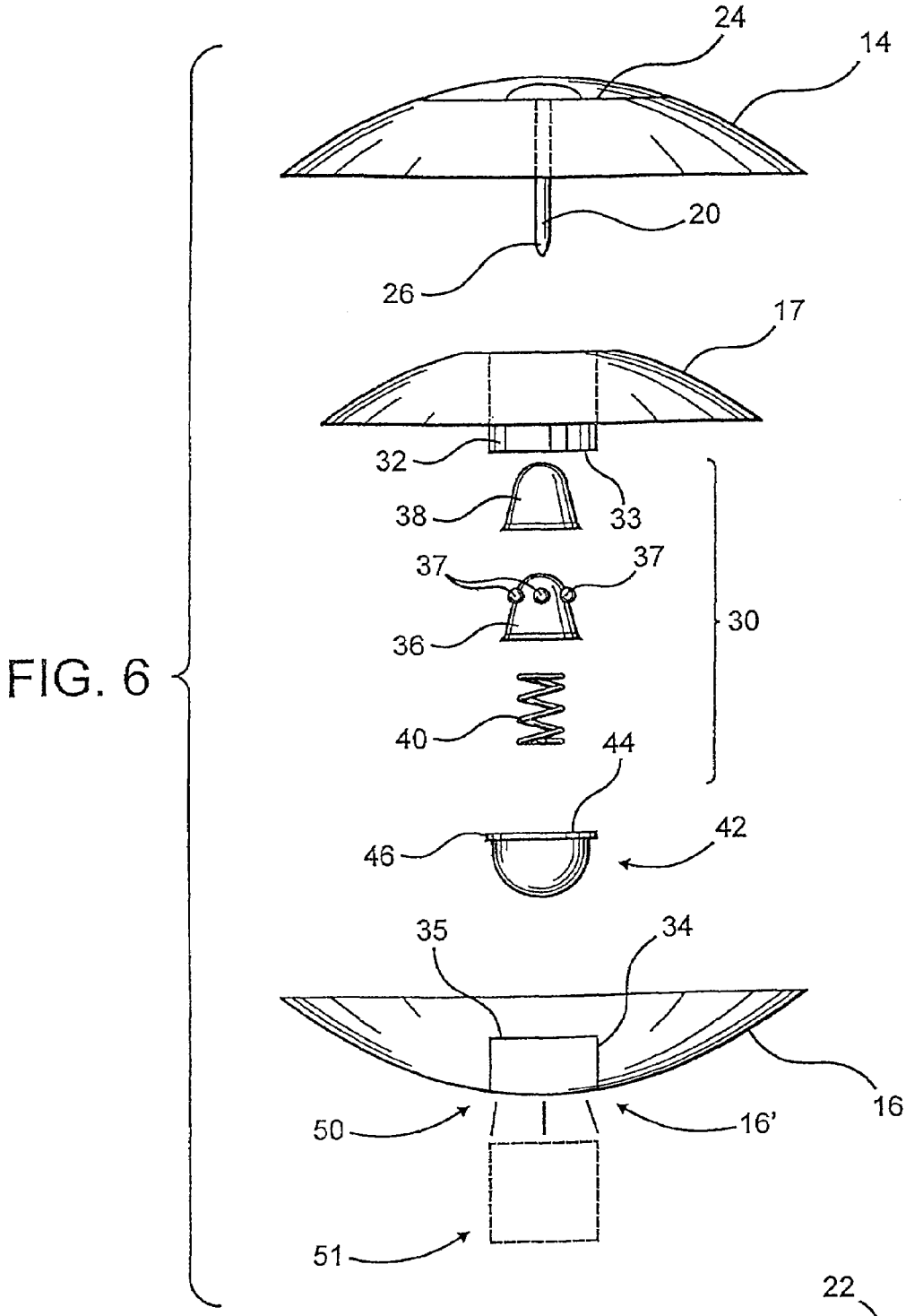
FIG. 6 is an exploded view of the preferred embodiment of FIGS. 1 through 5 disclosing the separable housing portions and the operable components contained therein.

As shown in the accompanying Figures, the present invention is directed to a security tag assembly generally indicated as 10 and including a housing generally indicated as 12. The housing includes a plurality of separable portions 14 and 16 structured to be lockingly but removably secured to one another, such as when in an operative position. The operative position is further defined by any of a plurality of different types of merchandise being secured between the separable housing portions 14 and 16 so as to extend outwardly from a commonly disposed peripheral seam 18. The merchandise (not shown for purposes of clarity) is therefore clamped between the separable portions 14 and 16 and is maintained in such a clamped position by a connector member 20 dimensioned and configured to penetrate and pass through the merchandise.

Further, as best shown in FIGS. 1 through 5 the separable housing portions 14 and 16 have substantially equivalent dimensions and configurations, so as to facilitate the formation of an extremely close, tight fitting, about the peripheral seam 18 generally defined by the corresponding peripheries of the separable portions. As such, there is virtually no spacing along the length of the peripheral seam 18 which would allow unauthorized personnel to pass a tool or instrument there between in an effort to separate the housing portions 14 and 16. Also, as described in greater detail hereinafter, an interior housing section 17 is provided to house and retain the various operative components of the tag assembly 10. Moreover, the interior housing section 17 is also cooperatively structured with the separable housing portions 14 and 16 by having a substantially convex or like exterior curved surface configuration, as shown in FIG. 3. Such a convex configuration further prohibits or significantly restricts the passage of an instrument or tool beyond the peripheral seam 18. Any such attempts would result in the penetrating end of such an instrument to immediately abut against the convex exterior surface of the housing section 17 as it rises or extends upwardly or outwardly beyond the peripheral seam 18.

Figure 7:
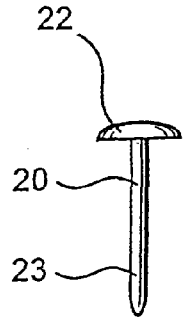
FIG. 7 is a front plan view of the connector member of a preferred embodiment of the present invention.

With primary reference to FIGS. 6 and 7, a preferred embodiment of the connector member 20 may be more specifically defined by an elongated pin or like structure formed of stainless steel or other hard, durable material. Further, the connector pin includes an enlarged head 22 embedded or otherwise fixedly and/or permanently secured within an interior end portion 24 of one of the separable portions, as at 14. The outer or distal end 26 of the connector member may or may not be sharpened or pointed and is disposed and structured to penetrate the merchandise. When so engaged by the connector member 20, the merchandise is maintained in the aforementioned operative position, clamped between and lockingly secured by separable portions 14 and 16.

The enlarged, outwardly extended or expanded configuration of the head 22 is such as to make it extremely difficult if not impossible to pass through the merchandise which has been penetrated by the shaft 23 of the connector pin 20. Accordingly, in the unlikely event that an unauthorized person were able to break through the outer surface of the separable portion 14 and some how dislodge the connector 20 therefrom, it would be impossible or extremely difficult to accomplish passage of the enlarged head 22 through the merchandise being penetrated by the relatively thin shaft 23. As set forth hereinafter, the shaft 23 will be lockingly engaged or gripped by the locking assembly generally indicated as 30. Therefore, in order to remove the merchandise from the connector 20, an unauthorized person would have to force the enlarged head 22 through the merchandise causing significant damage and thereby rendering the merchandise useless.

Other structural components of the security tag assembly 10 of the present invention include an interior housing section 17 mounted on within the housing 12 as shown in FIGS. 3, 5 and 6. The interior housing section 17 is cooperatively disposed, configured and structured with one of the separable portions, such as at 16, to movably and operably contain a locking assembly generally indicated as 30. The locking assembly 30 is movably mounted within a first sleeve portion 32 secured to the interior housing section 17. Similarly, when assembled, the various components of the locking assembly 30 are cooperatively and movably positioned relative to one another within a second sleeve structure 34 secured to the separable housing portion 16. Both the sleeve 32 and the sleeve 34 comprise hollow interiors and at least one open end 33 and 35 respectively. In addition, the interior housing section 17 includes a central bore or opening 19 disposed to receive the passage of the connector member 20 therethrough as it is disposed in locking but removable engagement with the locking assembly 30.

In at least one preferred embodiment of the present invention, the locking assembly 30 includes a locking member 36 having a plurality of balls, rollers or like movable members 38 embedded therein and movable inwardly into the interior of the locking member 36. The balls 37 are positioned into frictional, retaining engagement with a portion of the connector member 20 passing through the interior of locking member 36. The locking member 36 includes a substantially conical configuration as shown in FIG. 6. Similarly, a locking retainer as at 38 also includes a somewhat conical configuration as well as having a substantially larger dimension than the locking member 36. The locking member 36 is received within the locking retainer 38 and due to the cooperative, conical configurations thereof, the plurality of balls 37 are forced inwardly, while remaining substantially coplanar with one another, into the interior of the locking member 36 and into frictional, locking engagement with the shaft 23 of the connector member 20. It is emphasized that the mounting of the balls 37 on the locking member 36 is such as to maintain them in a common plane or at a common height relative to the longitudinal dimension of the locking member 36. Therefore, as the balls 37 are allowed to move, at least partially, into and outwardly from the interior of the locking member 36 all of the plurality of balls 37 are maintained in a common plane. This assures a maximum gripping or locking engagement with the shaft 23 of the connector member 20, since the balls 37 are substantially opposing one another in the aforementioned common plane, as they concurrently engage the shaft 23 at a common location thereon.

Also, because of the cooperative conical configuration of both the locking member 36 and the retainer member 38, the balls or like members 37 are maintained in locking engagement with the connector member 20, until the locking member 36 is forced at least partially outward from the interior of the retaining member. Therefore, the locking assembly 30 also includes a biasing spring as at 40 which, when normally positioned in its operative orientation, serves to bias locking member 36 upwardly into the interior of the retaining member 38. As set forth above, the balls or like members 37 are thereby normally maintained in an inwardly directed orientation which serves to lockingly engage the connector member 20, in the operative position, when it passes through the locking retainer 38 and into the interior of the locking member 36.

Although not clearly shown, it should be noted that both the locking member 36 and the locking retainer member 38 include through bores or openings in the respective, substantially closed ends thereof. These bores are aligned with the bore 19 in the interior housing section 17 so as to allow the connector member 20 to pass into and out of locked engagement with the locking assembly 30.

Another feature of a preferred embodiment of the present invention comprises a shield assembly generally indicated as 42. The shield assembly 42 is formed of a heat and/or flame resistant material such as a metallic material. Further, the shield assembly 42 includes what may be considered a "cup-like" configuration comprising a hollow interior and at least one open end 44. Further, an outwardly extending peripheral rim 46 surrounds the open end 44. The shield assembly 42 is disposed within the interior of the sleeve 34 mounted on or integrally secured to the separable portion 16. Passage of the shield assembly 42 through the open end 35 of the sleeve 34 is readily accomplished to the extent that the peripheral rim 46 rests on or about the perimeter of the open end 35 and facilitates a frictional engaging relation between the shield assembly 42 and the interior of the sleeve 34.

Therefore, in its assembled form the biasing spring 40 is disposed within the interior of the shield assembly 42 such that one end thereof bottoms out against the interior surface of the shield assembly 42. The locking member 36 is biased and maintained at least partially within the interior of the retaining member 38, due to the position of the biasing spring 40. The retaining member 38 and locking member 36 are also substantially enclosed or at least partially surrounded within the interior of the cup-like shield assembly 42. Accordingly, the open end 46 of the shield assembly 42 is sufficiently dimensioned to receive the spring 40, the locking member 36 and the retaining member 38 therein. Similarly, the sleeve 32 substantially surrounds the exterior surface of the sleeve 34 so as to complete the assembly of the aforementioned operative components. The sleeve 32 and the sleeve 34 may be permanently bonded such as by ultrasonic welding or other applicable means. As such, the locking assembly 30 is protected by the shield assembly 42 on the interior of the housing between interior surface portions of the interior housing section 17 and the separable portion 16.

As set forth above, the provision of the biasing spring 40 normally directs the rollers or balls 37 inwardly into the interior of the locking member 36 and into frictional, locking engagement with the shaft of the connector member 20. However, upon the application of an external force generally adjacent the exterior as at 16' of the separable portion 16, the locking assembly 30 may be moved at least partially outward from the locking retainer 38. The locking member 36 will then be disposed in an unlocked position so as to facilitate the removal of the connector member 20 therefrom. The separable portions 14 and 16 can then be removed from one another out of the aforementioned operative position.

In at least one preferred embodiment of the present invention the aforementioned external force is supplied in the form of a magnetic force schematically represented and indicated as 50. The housing 12, when disposed and locked in its operative position, as generally shown in FIG. 1, can be disposed within the magnetic field 50 of a magnet assembly generally indicated as 51. Exposure to the magnetic field 50 will serve to move the locking member 36 at least partially outward from the retainer member 38 and towards and against the biasing force of the biasing spring 40. Once the locking member is so positioned, the balls 37 are allowed to move outwardly from the interior of the locking member 36, enabling the release of the shaft of the connector member 20 therefrom. The separable portions 14 and 16 may be disconnected and removed out of the aforementioned operative position.

The shield assembly 42 is maintained in protective relation to the locking assembly 30 by at least partially surrounding at least a majority thereof. The shield assembly 42 thereby protects the locking member from external access or manipulation such as when external heat or flame is applied to an adjacent area 16' of the housing in the vicinity of the locking assembly 30.

Figure 8:
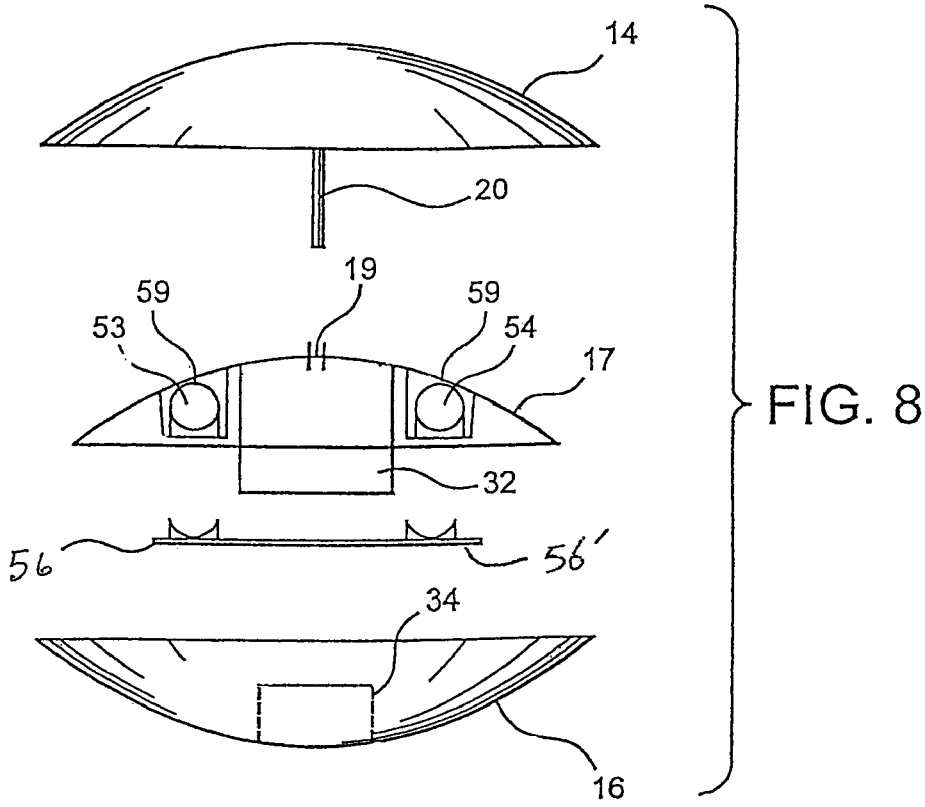
FIG. 8 is an exploded view of the separable components of the housing of the embodiment of FIG. 1 including details of an indicator assembly associated with the interior housing section disclosed in the embodiments of FIGS. 3, 5 and 6.
Figure 9:
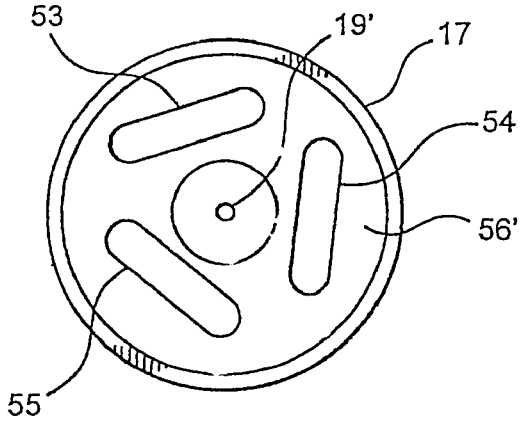
FIG. 9 is a front plan view of the interior housing section having an indicator assembly mounted thereon.
Figure 10:
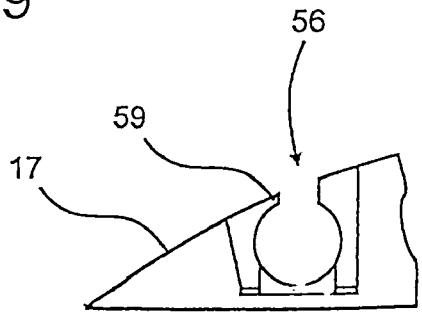
FIG. 10 is a retainer portion associated with the indicator assembly of at least one preferred embodiment of the security tag assembly of the present invention.

With primary reference to FIGS. 8 through 10, the security tag assembly 10 of the present invention further comprises an indicator assembly including at least one but preferably a plurality of indicator members 53, 54 and 55. These indicator members are mounted on or within a mounting retainer 56 secured to an interior and/or underside of the interior housing section 17 in engaging and/or retaining relation thereto. The indicator members 53, 54 and 55 may have common structural and operative features or may differ. By way of example, one or more of the indicator members 53, 54, and 55 may include an ink or staining agent which is released such as through openings or apertures 59 formed in an appropriate location on the interior housing section 17. Alternatively, an undersurface of the retainer 56 as at 56' as represented in FIGS. 8 and 9 may include openings for the exposure of the one or more indicator members 53, 54 and 55. Forced and unauthorized separation of the separable portions 14 and 16 of the housing will serve to rupture the ink or staining agent capsules thereby disbursing the ink, etc. onto the merchandise and rendering the merchandise useless.

Figure 9A:
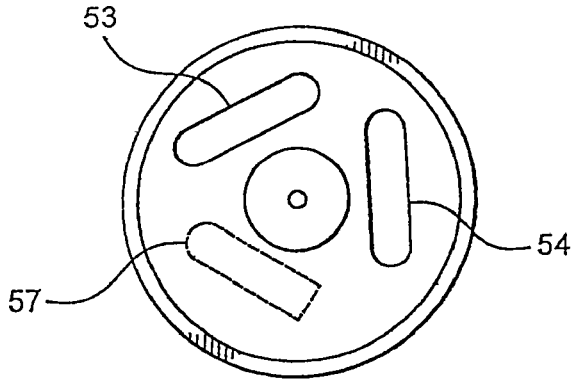
FIG. 9A is a front plan view of another preferred embodiment of the interior housing section wherein an additional indicator assembly is represented in phantom lines.

Another preferred embodiment of the indicator assembly is depicted in FIG. 9A. As shown therein, at least one of a plurality of indicators may include an indicator member 57 comprising an electronic signaling device. The electronic signaling device 57 is structured to activate an associated alarm system located at a monitoring station typically positioned at the exits of a retail establishment or other area being monitored. The electronic signaling device 57 may be mounted beneath the surface 56' and substantially within the space between the retainer 56 and the separable portion 16. Accordingly, the embodiment of FIG. 9A comprises the indicator assembly including one or more indicator members 53 and 54 in the form of staining agent capsules in combination with the indicator member in the form of the electronic signaling device 57.

Further, the space within the interior housing section 17 is sufficient to mount a plurality of additional and different types of signaling devices including, but not limited to, the electronic signaling device 57. It is further emphasized that the tag assembly 10 of the present invention is structured and dimensioned to accommodate many different types of indicators including a variety of different electronic signaling or warning devices. All of these devices may be mounted within the space between the retainer 56 and the interior of the interior housing section 17, without modifying the dimension, configuration or overall structure of the housing 12 or the other operative components of the tag assembly 10.

Accordingly, one feature of the present invention is the ability to standardize the overall structure of the security tag assembly 10 of the present invention, including the separable portion 14 and 16 and the interior housing section 17. As such, various, preselected ones of the indicator members 53, 54 and 55 may be included by the manufacture or provider so as to effectively "customize" the indicator assembly without requiring a change in the dimension, configuration or overall structure of the remainder of the security tag assembly 10. Such "customization" will better satisfy the needs and desires of the customer and user of the security tag assembly of the present invention without adding to the cost of manufacture and assembly of the present invention.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A security tag assembly structured to discourage the unauthorized removal of merchandise from a given area, said security tag comprising:

a) a housing including separable portions removably connected to one another in an operative position along a continuous peripheral seam, b) a connector member secured to an interior of said housing and structured to pass through and connect the merchandise to said housing, c) a locking assembly removably securable to said connector member and cooperatively structured therewith to removably secure said separable portions in continuous, substantially confronting relation along said peripheral seam in said operative position, d) an interior housing section having a continuous periphery disposed within one of said separable portions and having an exterior surface extending outwardly from said one separable portion into the other of said separable portions, e) said exterior surface having a substantially continuously curved configuration extending into the other of said separable portions in inwardly spaced relation to said peripheral seam, f) an indicator assembly including a plurality of indicator structures comprising breakable ink ampules containing a staining agent disposed within and in enclosed relation to said interior housing section, g) said interior housing section comprising a plurality of openings disposed and structured to establish passage of said staining agent to the merchandise upon breaking of at least one of said plurality of ink ampules when said separable portions are in said operative position, and h) a shield assembly disposed within said housing in at least partially enclosing relation to said locking assembly and structured to restrict unauthorized access to said locking assembly and an interior of said separable portions from the exterior of said housing.

2. A security tag assembly as recited in claim 1 wherein said shield assembly comprises a one piece construction of heat resistant material.

3. A security tag assembly as recited in claim 1 wherein said connector member and said locking assembly are attached to different ones of said separable portions of said housing.

4. A security tag assembly as recited in claim 1 wherein said plurality of indicator structures comprise three breakable ink ampules, each containing said staining agent and disposed in generally surrounding relation to said connector member.

5. A security tag assembly as recited in claim 1 wherein said exterior curved surface comprises a substantially convex configuration extending continuously over at least a majority of said interior housing section.

6. A security tag assembly as recited in claim 1 wherein said ink ampules are disposed in a generally triangular orientation so as to generally and collectively surround said connector member.

7. A security tag assembly as recited in claim 5 wherein said convex exterior curved surface is disposed in spaced, communicating relation to said peripheral seam and in interruptive relation to an article inserted through said peripheral seam into said interior of said separable portions.

8. A security tag assembly as recited in claim 7 wherein said convex exterior surface is disposed and configured to direct the article into engaging relation to said indicator assembly.

9. A security tag assembly as recited in claim 8 wherein said convex exterior curved surface is disposed and configured to direct the article into breaking engagement with at least one of said plurality of ink ampules through said openings.

10. A security tag assembly as recited in claim 1 further comprising a mounting retainer connected to said interior housing section and structured to support said plurality of ink ampules on an interior of said interior housing section and in adjacent, fluid communicating relation to said plurality of openings.

11. A security tag assembly as recited in claim 1 wherein said shield assembly includes a hollow interior and an open end communicating with said hollow interior; said locking assembly disposed within said hollow interior through said open end; said shield assembly formed of a heat resistant material and having a cup-like configuration disposed in enclosing, protective relation to at least a majority of said locking assembly.

12. A security tag assembly as recited in claim 11 wherein said shield assembly is connected to one of said separable portions and disposed in a position relative to both said one separable portion and said locking assembly to restrict exposure of said locking assembly to a heat source applied externally of said one separable portion.

* * * * *